US009056215B2

(12) United States Patent
Canales et al.

(10) Patent No.: US 9,056,215 B2
(45) Date of Patent: Jun. 16, 2015

(54) HALF-PIPE TRAMPOLINE

(76) Inventors: A. Michael Canales, Orlando, FL (US); Wayne Jewell, Carpinteria, CA (US)

( * ) Notice: Subject to any disclaimer, the term of this patent is extended or adjusted under 35 U.S.C. 154(b) by 345 days.

(21) Appl. No.: 13/506,786

(22) Filed: May 17, 2012

(65) Prior Publication Data

US 2013/0310223 A1 Nov. 21, 2013

(51) Int. Cl.

| | |
|---|---|
| ***A63B 21/00*** | (2006.01) |
| ***A63B 5/11*** | (2006.01) |
| *A63B 6/02* | (2006.01) |

(52) U.S. Cl.
CPC .... *A63B 5/11* (2013.01); *A63B 6/02* (2013.01)

(58) Field of Classification Search
USPC ..... 482/27, 28
See application file for complete search history.

(56) References Cited

U.S. PATENT DOCUMENTS

| | | | | |
|---|---|---|---|---|
| 8,764,575 | B1 * | 7/2014 | Gurley | 472/92 |
| 2007/0010374 | A1 * | 1/2007 | Widich | 482/27 |
| 2013/0196823 | A1 * | 8/2013 | DeBlanco | 482/27 |
| 2013/0310223 | A1 * | 11/2013 | Canales et al. | 482/27 |

* cited by examiner

*Primary Examiner* — Jerome W Donnelly
(74) *Attorney, Agent, or Firm* — Sidney W. Kilgore, Esq.; Sidney W. Kilgore, P.A.

(57) ABSTRACT

A half-pipe trampoline is comprised of a horizontal trampoline runway with inclined trampoline beds angled approximately 45-53 degrees relative to the surface of the horizontal trampoline runway. The inclined trampoline beds are positioned all along the length of the horizontal trampoline runway, thus creating a three-dimensional corridor or track of flexible trampoline surface for the participants.

The inclined trampoline beds are connected directly to the horizontal trampoline runway, rather than to a rigid frame. To accomplish this, rigid frames are positioned around the periphery of the trampoline surfaces rather than underneath those surfaces, keeping them well away from the trampoline surfaces. Chains and springs are used to span the distance between frames and the horizontal trampoline runway. Additional chain is stretched from the horizontal trampoline runway to the floor to keep the inclined trampoline beds from pulling on the horizontal trampoline runway.

7 Claims, 4 Drawing Sheets

HALF-PIPE TRAMPOLINE

CROSS-REFERENCES TO RELATED APPLICATIONS

Not applicable.

STATEMENT REGARDING FEDERALLY SPONSORED RESEARCH OR DEVELOPMENT

Not applicable.

MICROFICHE APPENDIX

Not applicable.

BACKGROUND OF THE INVENTION

1. Field of the Invention

This invention relates to the field of trampolines.

2. Description of Related Art

A typical trampoline is a device consisting of a piece of taut, strong fabric stretched within a steel frame using many coiled springs. People bounce on trampolines for recreational and competitive purposes. The fabric on which users bounce (commonly known as the 'bounce mat' or 'trampoline bed') is usually not elastic in itself; the elasticity is provided by the springs that connect it to the frame.

Ordinarily, trampolines consist of two-dimensional surfaces. While some trampolines have inclined trampoline beds adjacent to the horizontal trampoline bed, these inclined beds are not connected directly to the horizontal bed, but either to a rigid grid frame or a cable or chain grid with rigid connection points. These designs tend to get in the way of participants bouncing on the trampoline and decrease safety for the participants, who may be injured by contact with the rigid frame or rigid connection points.

BRIEF SUMMARY OF THE INVENTION

A half-pipe trampoline is a trampoline comprised of a horizontal trampoline runway, typically rectangular in shape, with inclined trampoline beds angled approximately 45-53 degrees relative to the surface of the horizontal trampoline runway. The inclined trampoline beds, in combination with the horizontal trampoline runway, create a three-dimensional corridor or track ("half-pipe") of flexible trampoline surface for the participants.

The inclined trampoline beds are connected directly to the horizontal trampoline runway, rather than to a rigid frame. There are no side rails for the horizontal trampoline runway. To accomplish this, rigid frames are positioned around the periphery of the trampoline surfaces rather than underneath those surfaces, keeping them well away from the trampoline surfaces. Sash chain is stretched from the horizontal trampoline runway and attached via springs and monkey wire to a flat bar bolted to the floor to keep the inclined trampoline beds from pulling on the horizontal trampoline runway.

The flat bar with monkey wire is bolted to the floor just inside the vertical posts of the incline trampoline frame. The inclined trampoline beds have D-rings sewn to the bottom on two sides where they angle up toward to the top of the inclined trampoline beds ("articulation points"). Sash chain and springs are used to tether the D-rings along the articulation points to the flat bar with monkey wire bolted to the floor. Jumping anywhere on either the horizontal or the inclined trampoline beds will apply loading to all the springs and move the articulation points. The springs for both the inclined trampoline beds and horizontal trampoline runway may have to be doubled due to the width of the bed plus springs plus chains in order to get the desired tension in the bed.

Flat bars are bolted to the floor just inside the vertical post of each inclined trampoline bed frame (a rigid frame adjacent to the inclined trampoline bed). Each flat bar may be 0.25" by 2" with monkey wire welded on the top and may have 7/16" holes every 18" or so.

The half-pipe trampoline may include a foam pit at one end. This feature allows participants to dismount into a soft and safe area.

REFERENCE NUMERALS IN THE DRAWINGS

1001 Horizontal Trampoline Runway
1002A,B Inclined Trampoline Beds
1003 Rigid Frame
1004 Padding
1005 Foam Pit
2001 Chain
2002 Monkey Wire
2003 Spring
2004 Sash Chain
2006 Flat Bar
3001 D-Rings

DETAILED DESCRIPTION OF THE INVENTION

The present invention, which may be described as a half-pipe trampoline, allows bouncers to bounce anywhere within the "pipe" shape of the bouncing surface without hitting any solid object. The entrance may be via stairs and a platform at one end.

Figure 1:
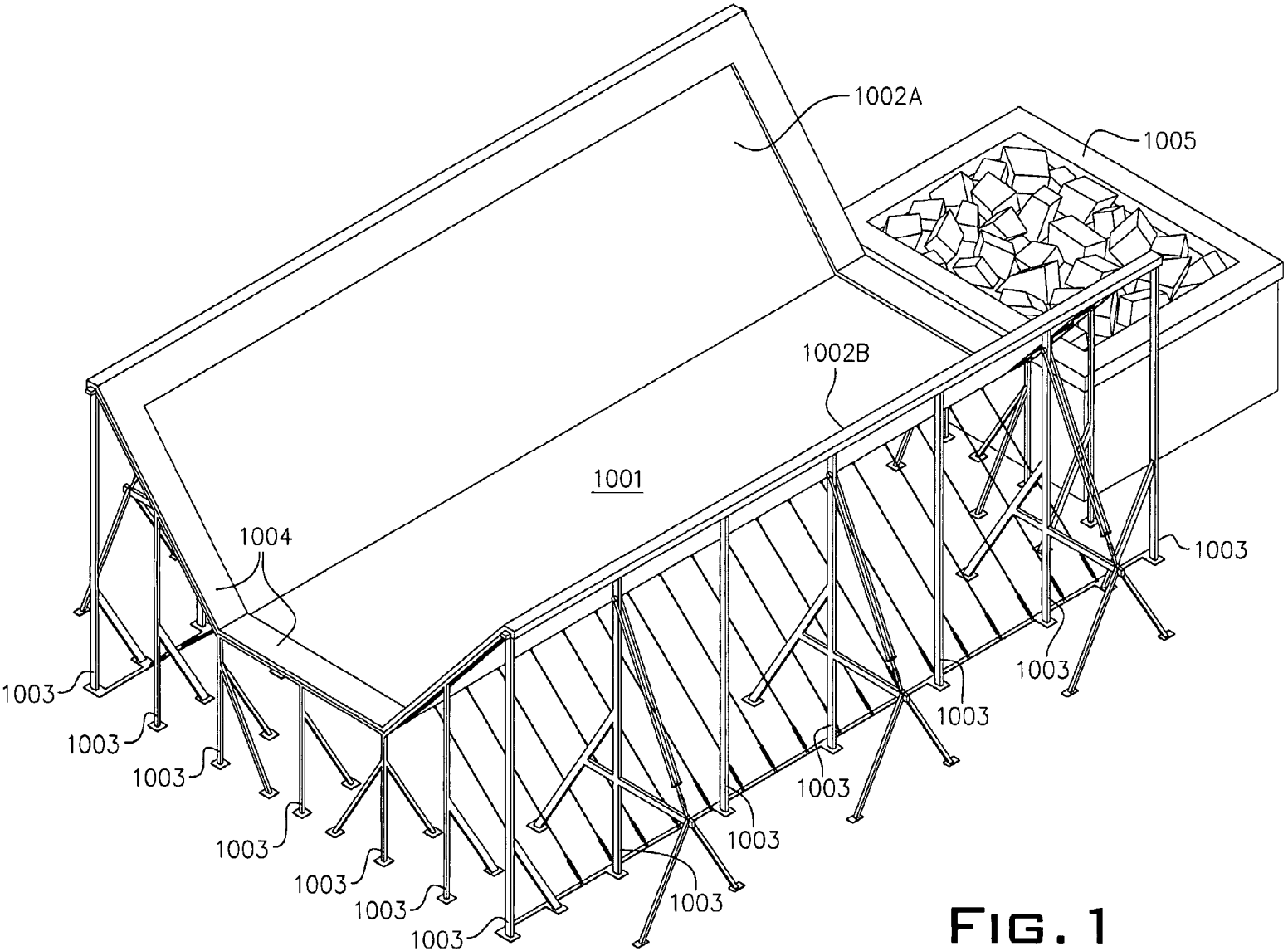
FIG. 1 is a perspective view of the basic structure of the half-pipe trampoline.

The basic layout of the half-pipe trampoline is shown in FIG. 1, and comprises a horizontal trampoline runway 1001, typically rectangular in shape. This horizontal trampoline runway 1001 is circumscribed by upwardly and outwardly extending inclined trampoline beds 1002A, 1002B set at 45-53 degree angles to the plane of the horizontal trampoline runway. The horizontal trampoline runway 1001 and inclined trampoline beds 1002A, 1002B are maintained by an arrangement of rigid frames 1003, which may be of steel or any other suitable material, secured to the floor underneath and around the periphery of the horizontal trampoline runway 1001 and the inclined trampoline beds 1002A, 1002B. The rigid frame holds the horizontal trampoline runway and inclined trampoline beds in place. Padding 1004 may be set around the periphery of the half-pipe trampoline, and a foam pit 1005 may be placed at the end of the horizontal trampoline runway 1001 opposite the entrance end to allow users to bounce or jump off safely.

Figure 2:
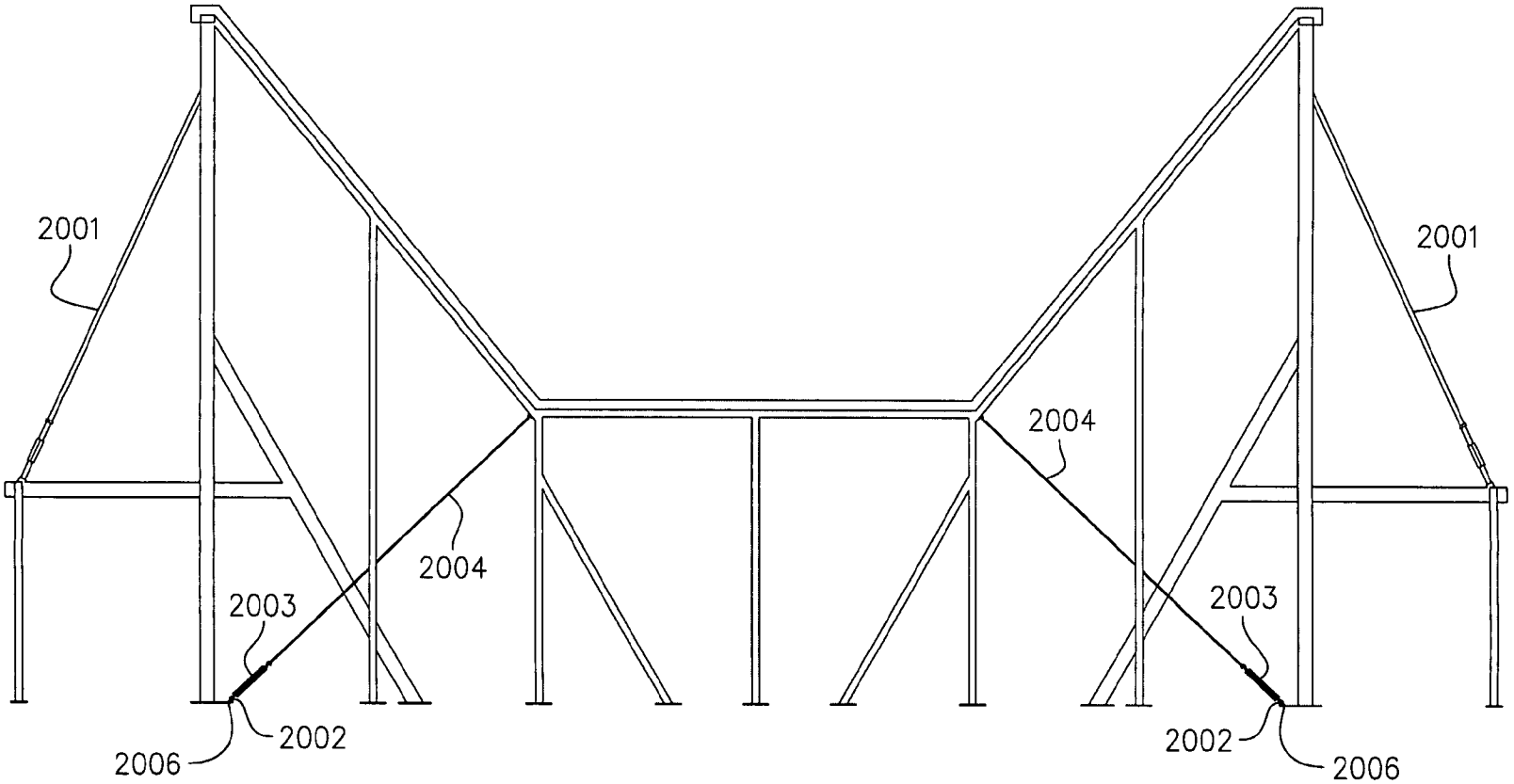
FIG. 2 is an end view of the steel frame.

FIG. 2 is an end view of the trampoline and illustrates the rigid frame 1003 at one end of the horizontal trampoline runway 1001. It further illustrates two combinations of springs 2003 and sash chains 2004 which extend from the rigid frame to a point at which the horizontal trampoline runway 1001 joins with an inclined trampoline bed 1002A, 1002B. The sash chain 2004 is attached to a spring 2003, which is in turn secured to the frame by means of monkey wire 2002—i.e., steel rod which may be one quarter ('A) inch in diameter and which may be (but not necessarily) formed in the shape of an S-hook—or other suitable attachment means.

Combinations of springs 2003 and sash chains 2004 hold the horizontal trampoline runway 1001 and the inclined trampoline beds 1002A,B taut without exposing the rigid frame 1003, sash chains 2004 or springs 2003 to the trampoline surface. The sash chains 2004 in the figure are connected to the horizontal trampoline runway 1001 and the inclined trampoline beds 1002A,B via D-rings 3001 (see FIG. 3) that connect the horizontal trampoline runway 1001 and the inclined trampoline beds 1002, and are then attached to the base of the rigid frame 1003 by means of monkey wire 2002 or other suitable attachment means, which may be welded or otherwise firmly attached to flat bars 2006, forming part of the rigid frame, which flat bars 2006 are bolted to the ground or floor. The flat bars may be made of steel or other suitable materials. Covered chains 2001 connect on either side of the rigid frame 1003 near the top of the inclined trampoline beds 1002A,B, and are used to adjust the tension of the rigid frame 1003.

Figure 3:
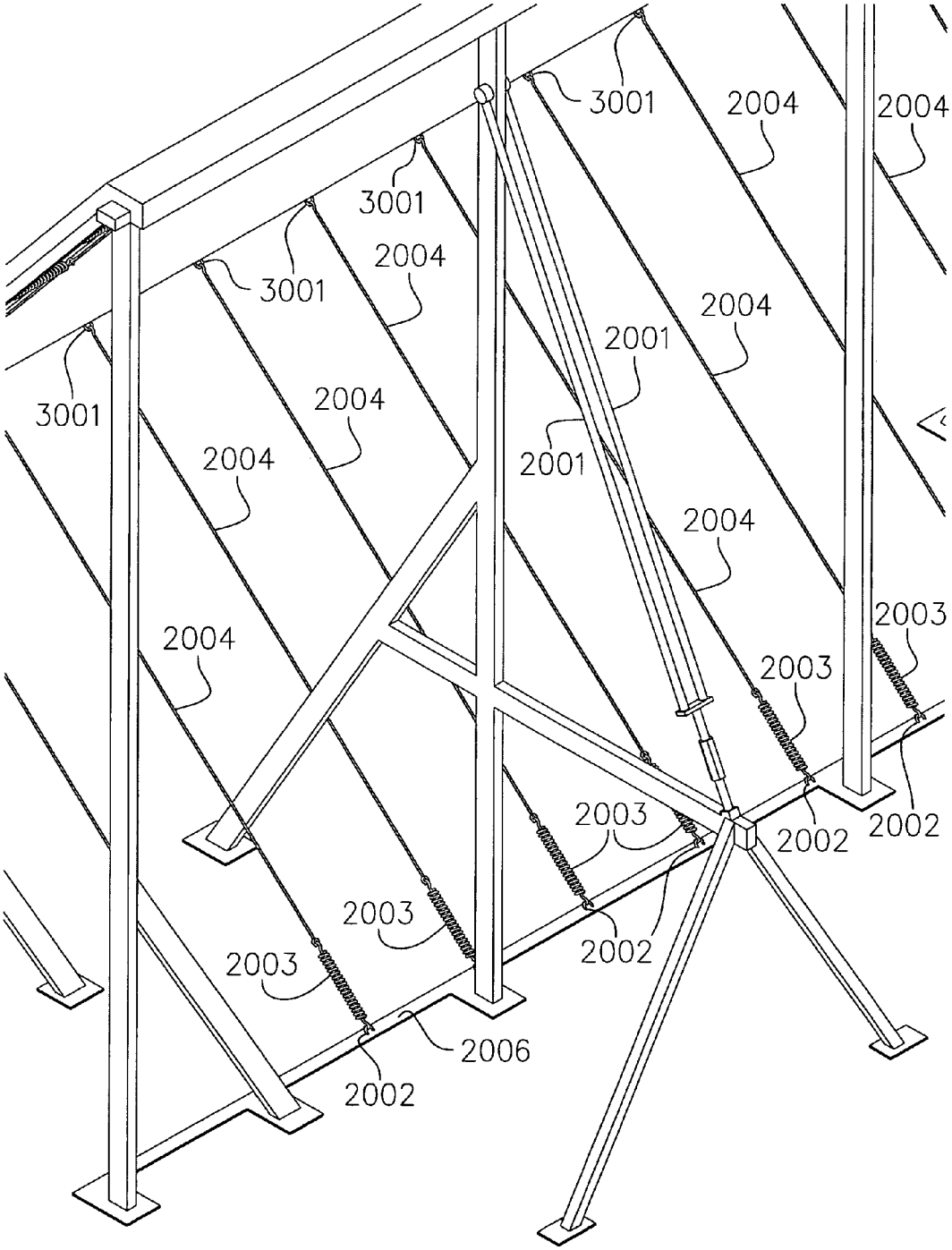
FIG. 3 is an enlarged perspective view of the framework, chain, sash chain, and springs.

FIG. 3 presents a more detailed view of one side of the half-pipe trampoline structure. Here the rigid steel frame 1003 is in place, and the row of sash chains 2004 and spring 2003 combinations are shown extending from the base of the rigid frame 1003 to the point where the horizontal trampoline runway 1001 and inclined trampoline beds 1002A,B are joined. D-Rings 3001 to which sash chains 2004 are connected at one end of each sash chain 2004 are clearly illustrated. This figure also reflects the covered chains 2001 that connect on either side of the rigid frame near the top of the inclined trampoline beds 1002 A,B, and which are used to adjust the tension of the rigid frame 1003.

Figure 4:
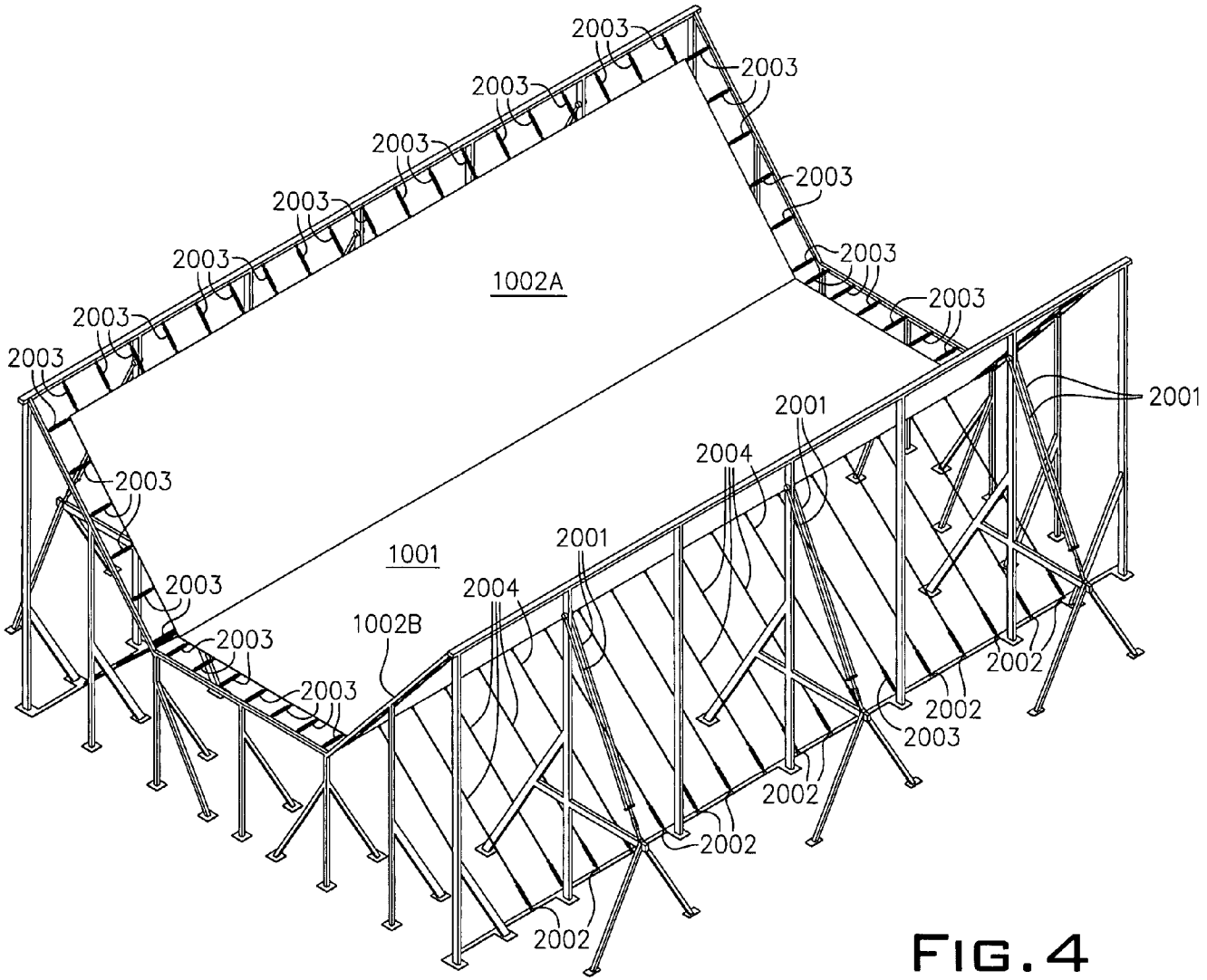
FIG. 4 is a perspective view of the half-pipe trampoline revealing the springs under the perimeter padding.

FIG. 4 shows the frame and structure of the half-pipe trampoline prior to placing protective padding 1004 over springs 2003 directly joining the outermost edges of the horizontal trampoline runway 1001 and the inclined trampoline beds 1002A,B to adjacent parts of the rigid frame 1003. All of the springs 2003 in the half-pipe trampoline provide the flexibility to the horizontal trampoline runway 1001 and the inclined trampoline beds 1002A,B that allows users to bounce.

The horizontal trampoline runway 1001 and the inclined trampoline beds 1002A,B are comprised of taut canvas, which is attached to the rigid frame 1003 on the outer sides, contributing to the rebounding capability of the horizontal trampoline runway 1001 and the inclined trampoline beds 1002A,B. The completed trampoline as in FIG. 1 shows these springs covered with padding 1004.

There is a flat bar 2006 bolted to the floor just inside the vertical posts of the rigid frame 1003 adjacent to each of the inclined trampoline beds 1002A,B. The inclined trampoline beds 1002A,B have D-rings 3001 sewn to the bottom on two sides where they angle up toward the top ("articulation points"). The D-rings 3001 are joined to the horizontal trampoline runway 1001. Sash chain 2004 and springs 2003 are used to tether the D-rings 3001 along the articulation points to monkey wire 2002 or other suitable attachment means, welded or otherwise firmly attached to each flat bar 2006 bolted to the floor. Jumping anywhere on either the horizontal trampoline runway 1001 or the inclined trampoline beds 1002A,B will apply loading to all the springs 2003 attached to sash chain 2004 and move the articulation points. The springs 2003 for both the inclined trampoline beds 1002A,B and the horizontal trampoline runway 1001 may have to be doubled due to the width of the bed plus springs 2003 plus sash chains 2004 in order to achieve the desired tension in the bed.

The flat bars 2006 are bolted to the floor just inside the vertical posts of each inclined trampoline bed. Each flat bar may be 0.25" by 2" with monkey wire 2002 or other suitable attachment means welded or otherwise suitably attached on the top and may have 7/16" holes every 18" or so.

What is claimed is:

1. A trampoline comprising a horizontal trampoline runway;

at least two upwardly and outwardly inclined trampoline beds circumscribing said horizontal trampoline runway and set at 45-53 degree angles relative to the plane of said horizontal trampoline runway, connected directly to said horizontal trampoline runway at articulation points by D-rings;

rigid frames positioned around the periphery of said horizontal trampoline runway and said inclined trampoline beds;

chains connected to said rigid frame, used to adjust the tension in said rigid frame;

sash chain attached at one end to each of said D-rings, and attached at the other end via a spring to monkey wire firmly attached to a flat bar bolted to a floor; and springs attaching the portions of said horizontal trampoline runway and said inclined trampoline beds directly to said rigid frame.

2. The trampoline of claim one, in which said horizontal trampoline runway is rectangular in shape.

3. The trampoline of claim one, in which said rigid frames are made of steel.

4. The trampoline of claim one, which said flat bar is made of steel.

5. The trampoline of claim one, in which said monkey wire is welded to the flat bar.

6. The trampoline of claim one, additionally comprising a foam pit at one end.

7. The trampoline of claim one, additionally comprising protective padding over the springs connecting the horizontal trampoline runway and inclined trampoline beds directly to the rigid frame.

* * * * *